US010163596B2

(12) United States Patent
Song et al.

(10) Patent No.: US 10,163,596 B2
(45) Date of Patent: Dec. 25, 2018

(54) HORIZONTAL-DEFLECTION PREVENTION MECHANISM FOR HIGH VOLTAGE DIRECT CURRENT RELAY

(71) Applicant: ZHEJIANG INNUOVO NEW ENERGY TECHNOLOGY CO., LTD., Dongyang, Zhejiang Province (CN)

(72) Inventors: Wenrong Song, Dongyang (CN); Rongai Yu, Dongyang (CN); Xiaobin Guo, Dongyang (CN); Haiyan Huang, Dongyang (CN); Peng Su, Dongyang (CN); Dejin Du, Dongyang (CN)

(73) Assignee: ZHEJIANG INNUOVO NEW ENERGY TECHNOLOGY CO., LTD., Dongyang (CN)

( * ) Notice: Subject to any disclaimer, the term of this patent is extended or adjusted under 35 U.S.C. 154(b) by 0 days.

(21) Appl. No.: 15/540,783

(22) PCT Filed: Jul. 7, 2016

(86) PCT No.: PCT/CN2016/089172
§ 371 (c)(1),
(2) Date: Jun. 29, 2017

(87) PCT Pub. No.: WO2017/107454
PCT Pub. Date: Jun. 29, 2017

(65) Prior Publication Data

US 2018/0025874 A1 Jan. 25, 2018

(30) Foreign Application Priority Data

Apr. 29, 2016 (CN) ..... 2016 1 0276456

(51) Int. Cl.
*H01H 50/54* (2006.01)
*H01H 50/58* (2006.01)
*H01H 50/36* (2006.01)

(52) U.S. Cl.
CPC ..... *H01H 50/58* (2013.01); *H01H 50/36* (2013.01); *H01H 50/546* (2013.01); *H01H 2235/01* (2013.01); *H01H 2239/044* (2013.01)

(58) Field of Classification Search
CPC ..... H01H 50/546
See application file for complete search history.

(56) References Cited

U.S. PATENT DOCUMENTS 4,345,224 A * 8/1982 Lenzing ..... H01H 1/2008 29/602.1

FOREIGN PATENT DOCUMENTS

DE 102007013572 A1 * 10/2008 ..... H01H 1/20

* cited by examiner

*Primary Examiner* — Ramon M Barrera
(74) *Attorney, Agent, or Firm* — Jiwen Chen

(57) ABSTRACT

The present invention discloses a horizontal-deflection prevention mechanism for an HVDC relay, comprising a moving contact assembly which comprises a moving reed and moving contacts arranged at left and right ends of the moving reed; an upper section of a pushrod is located above a yoke plate and fixed with the moving reed; a positioning plate is provided on the yoke plate; and a left return spring is connected between a left end of the moving reed and the positioning plate, and a right return spring is connected between a right end of the moving reed and the positioning plate. In the present invention, by the arrangement of a left return spring and a right return spring at the left and right ends of the moving reed at which moving contacts are provided, on one hand, a breaking force can be provided, which allows the moving contacts to quickly separate from the stationary contacts when the moving contacts and the (Continued)

stationary contacts are to be separated from each other, so that the relay makes a response quickly. On the other hand, the left return spring and the right return spring always provide an acting force which prevents the moving reed from rotating horizontally, so as to ensure that the moving contacts and the stationary contacts can come into contact precisely and to thus prevent the occurrence of faults due to the contact between the moving reed and other components.

16 Claims, 9 Drawing Sheets

HORIZONTAL-DEFLECTION PREVENTION MECHANISM FOR HIGH VOLTAGE DIRECT CURRENT RELAY

This is a U.S. national stage application of PCT Application No. PCT/CN2016/089172 under 35 U.S.C. 371, filed Jul. 7, 2016 in Chinese, claiming priority of Chinese Application No. 201610276456.X, filed Apr. 29, 2016, all of which are hereby incorporated by reference.

TECHNICAL FIELD OF THE INVENTION

The present invention relates to a high voltage direct current (HVDC) relay, and in particular to a horizontal-deflection prevention mechanism for an HVDC relay, which is configured to prevent a moving reed inside the HVDC relay from deflecting.

BACKGROUND OF THE INVENTION

In HVDC relays, a pushrod is driven to move upward and downward by a moving iron core, so that the moving contacts and the stationary contacts on a moving reed at the upper end of the pushrod are contacted or separated with or from each other. In the prior art, since the pushrod connecting the moving iron core and the moving reed is guided only in the axial direction without any position limit in the circumferential direction of the pushrod, the pushrod might rotate upward in the circumferential direction when moving upward and downward, leading to the deflection of the moving reed fixed with the pushrod in the horizontal direction. As a result, the moving contacts and the stationary contacts cannot be precisely aligned, and the reliability of the relay is affected.

SUMMARY OF THE INVENTION

An object of the present invention is to provide a horizontal-deflection prevention mechanism for an HVDC relay, which is capable of preventing a moving reed from deflecting horizontally, ensuring the precise contact between the moving contacts and the stationary contacts of the relay, and improving the reliability of the relay.

To achieve the purpose mentioned above, the present invention adopts the following technical solution. A horizontal-deflection prevention mechanism for an HVDC relay is provided, comprising a moving contact assembly which comprises a moving reed and moving contacts arranged at left and right ends of the moving reed; an upper section of a pushrod is located above a yoke plate and fixed with the moving reed; a positioning plate is provided on the yoke plate; and a left return spring is connected between a left end of the moving reed and the positioning plate, and a right return spring is connected between a right end of the moving reed and the positioning plate.

In the present invention, by the arrangement of a left return spring and a right return spring at the left and right ends of the moving reed at which moving contacts are provided. On one hand, a breaking force can be provided, which allows the moving contacts to quickly separate from the stationary contacts when the moving contacts and the stationary contacts are to be separated from each other as the left return spring and the right return spring directly act on the moving reed, so that the relay makes a response quickly. On the other hand, since the two ends of the moving reed are tensioned and act on the positioning plate, the left return spring and the right return spring always provide an acting force which prevents the moving reed from rotating horizontally, so as to ensure that the moving contacts and the stationary contacts can come into contact precisely and to thus prevent the occurrence of faults due to the contact between the moving reed and other components. Wherein, the positioning plate is made of insulating material, for example, plastics.

Preferably, a spring fixing plate extending upward is respectively formed on the positioning plate at a position below and corresponding to the left end of the moving reed and at a position below and corresponding to the right end of the moving reed; a lower spring fixing hole is formed on the spring fixing plate; and a protection ring is matched on an inner wall of the lower spring fixing hole. Wherein, the protection ring can be made of material with certain stiffness, for example, an iron ring, so as to prevent the spring fixing plate of the positioning plate from being broken by the left return spring and the right return spring, and thus the reliability of the relay is guaranteed.

Preferably, both an axis of the left return spring and an axis of the right return spring are parallel to an axis of the pushrod; and both a connecting point between the left return spring and the moving reed and a connecting point between the right return spring and the moving reed are located between the two moving contacts and are close to an inner side of the moving contacts. Since both the axis of the left return spring and the axis of the right return spring are parallel to the axis of the pushrod, the moving reed can become more stable in the horizontal direction.

Preferably, the connecting point between the left return spring and the moving reed and the connecting point between the right return spring and the moving reed are separately located on different sides of the moving reed, i.e., a front side and a rear side. Wherein, the connecting point between the left return spring and the moving reed and the connecting point between the right return spring and the moving reed are, respectively, arranged on the front side and the rear side of the moving reed, so that the anti-deflection force of the left return spring and the right return spring against the moving reed is further increased.

Preferably, both the connecting point between the left return spring and the moving reed and the connecting point between the right return spring and the moving reed are located on a front side of the moving reed or on a rear side of the moving reed. The positions of the left return spring and the right return spring can be selected as desired. Wherein, when the left return spring and the right return spring are arranged on the same side, the moving reed will be inclined; and there will be rubbing actions when the moving contacts and the stationary contacts are contacted or separated with or from each other, so as to ensure the contact between the moving contacts and the stationary contacts.

Preferably, the connecting point between the left return spring and the moving reed and the connecting point between the right return spring and the moving reed are located in a front-rear symmetric centerline of the moving reed.

Preferably, an upper spring fixing hole is respectively provided on two ends of the moving reed; the spring fixing plate comprises a left spring fixing plate and a right spring fixing plate; and a lower spring fixing hole is formed on the left spring fixing plate, and a lower spring fixing hole is formed on the right spring fixing plate.

Preferably, both the left return spring and the right return spring are S-shaped extension springs. The above arrangement can ensure the stability of the present invention.

Preferably, a magnetic metal clip having an enclosed structure and an insulating plate are provided on the yoke plate; the yoke plate and the insulating plate are fixed by a fastener so that the magnetic metal clip is defined between the yoke plate and the insulating plate; a chamber for accommodating a stationary contact assembly and a moving contact assembly is formed by the insulating plate, the magnetic metal clip and the yoke plate; the stationary contact assembly comprises a leading-out end and stationary contacts fixed on the leading-out end, and the leading-out end is fixed with the insulating plate; and an upper end surface of the positioning plate resists against the magnetic metal clip, and a lower end surface of the positioning plate resists against the yoke plate. The above arrangement is configured to fix the positioning plate, and the positioning plate is tightly clamped between the magnetic metal clip and the yoke plate.

Preferably, there is a positioning frame extending upward from the positioning plate, and the magnetic metal clip is sleeved on the outer periphery of the positioning frame. The arrangement of the positioning frame can promise no deflection of the magnetic metal clip in the horizontal direction.

The present invention has the advantages of preventing a moving reed from deflecting horizontally, ensuring the precise contact between the moving contacts and the stationary contacts of the relay, improving the reliability of the relay, and the like.

DETAILED DESCRIPTION OF THE INVENTION

Embodiment 1

Figure 1:
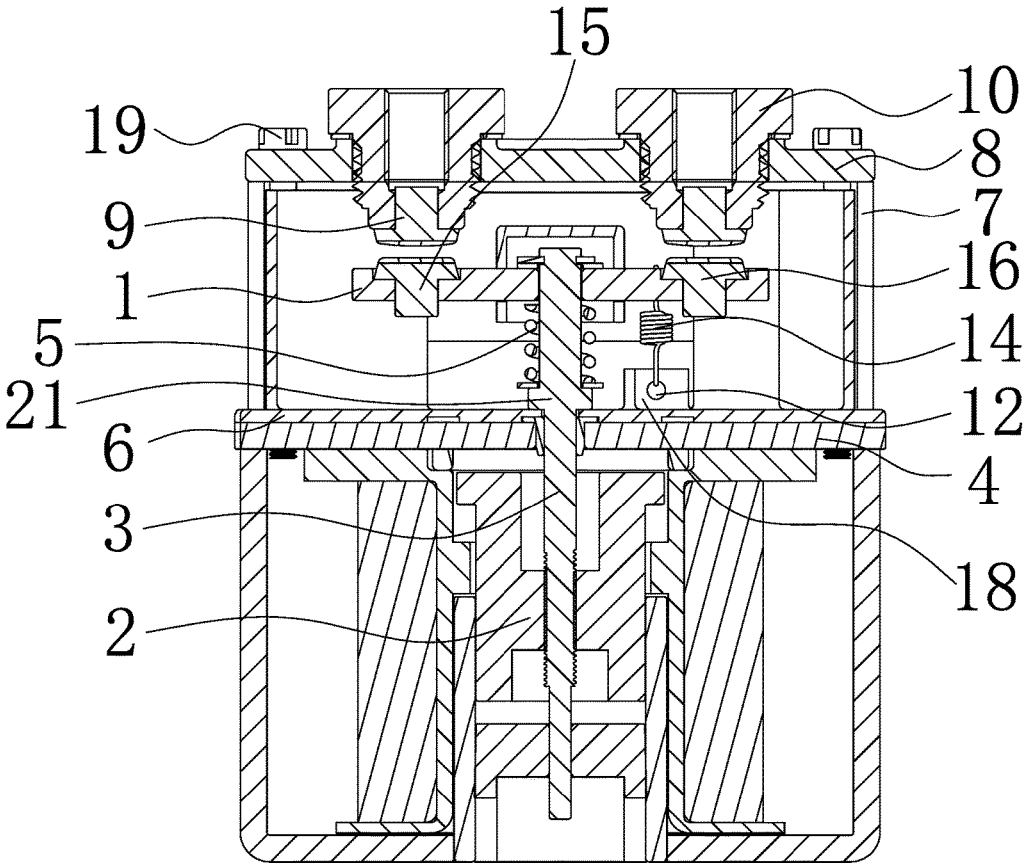
FIG. 1 is a first structure diagram according to Embodiment 1 of the present invention.

As shown in FIG. 1, FIG. 2, FIG. 3, FIG. 4 and FIG. 5, the present invention provides a horizontal-deflection prevention mechanism for an HVDC relay, comprising a moving contact assembly which comprises a moving reed 1 and moving contacts arranged at left and right ends of the moving reed 1; an upper section of a pushrod 3 fixed with a moving iron core 2 is located above a yoke plate 4 and fixed with the moving reed 1; a main spring 5 is sleeved on the pushrod 3; a positioning plate 6 made of insulating plastic is provided on the yoke plate 4; a left return spring 13 is connected between a left end of the moving reed 1 and the positioning plate 6, and a right return spring 14 is connected between a right end of the moving reed 1 and the positioning plate 6; and both the left return spring 13 and the right return spring 14 are S-shaped extension springs. A boss 21 is formed on an upper section of the pushrod 3 located above the yoke plate 4; and a lower end of the main spring 5 resists against the boss 21, and an upper end of the main spring 5 resists against the moving reed 1.

Both an axis of the left return spring 13 and an axis of the right return spring 14 are parallel to an axis of the pushrod 3; and both a connecting point between the left return spring 13 and the moving reed 1 and a connecting point between the right return spring 14 and the moving reed 1 are located between the two moving contacts and are close to an inner side of the moving contacts.

An upper spring fixing hole 11 is provided at a left end of the moving reed, and an upper spring fixing hole 11 is provided at a right end of the moving reed; and an upper end of the left return spring 13 is located inside the upper spring fixing hole at the left end, and an upper end of the right return spring 14 is located inside the upper spring fixing hole at the right end. The moving contacts comprise a left moving contact 15 and a right moving contact 16; and the upper spring fixing hole 11 at the left end of the moving reed is located on the inner side of the left moving contact 15, and the upper spring fixing hole 11 at the right end of the moving reed is located on the inner side of the right moving contact 16.

A spring fixing plate extending upward is respectively formed on the positioning plate 6 at a position below and corresponding to the left end of the moving reed 1 and at a position below and corresponding to the right end of the moving reed; a lower spring fixing hole 12 is formed on the spring fixing plate; and a protection ring is matched on an inner wall of the lower spring fixing hole 12, and the protection ring is an iron ring. The spring fixing plate comprises a left spring fixing plate 17 located on the left side and a right fixing plate 18 located on the right side; and a lower spring fixing hole 12 is formed on each of the left spring fixing plate 17 and the right spring fixing plate 18.

The connecting point between the left return spring 13 and the moving reed 1 and the connecting point between the right return spring 14 and the moving reed 1 are separately located on different sides of the moving reed 1, i.e., a front side and a rear side. The upper spring fixing hole of the left return spring 13 is located on the front side of the moving reed, and the upper spring fixing hole of the right return spring 14 is located on the rear side of the moving reed. Cross-sections of the left spring fixing plate 17 and the right spring fixing plate 18 are arranged in a T-shape. Each of the left spring fixing plate and the right spring fixing plate comprises a first portion and a second portion, so that the cross-section of the right spring fixing plate is T-shaped; the lower spring fixing hole is arranged on the first portion; and the first portion of the left spring fixing plate is arranged to be parallel to the first portion of the right spring fixing plate, and the second portion of the left spring fixing plate is arranged to be parallel to the second portion of the right spring fixing plate.

As shown in FIG. 1, a magnetic metal clip 7 having an enclosed structure and an insulating plate 8 made of ceramic are provided on an upper side of the yoke plate 4; the yoke plate 4 and the insulating plate 8 are fixed by a fastener so that the magnetic metal clip 7 is defined between the yoke plate 4 and the insulating plate 8; a chamber for accommodating a stationary contact assembly and a moving contact assembly is formed by the insulating plate 8, the magnetic metal clip 7 and the yoke plate 4; the stationary contact assembly comprises a leading-out end 10 and stationary contacts 9 fixed on the leading-out end, and the leading-out end 10 and the insulating plate 8 are brazed or fixed by threads; an upper end surface of the positioning plate resists against the lower end of the magnetic metal clip, and a lower end surface of the positioning plate resists against the yoke plate; and the positioning plate 6 is tightly clamped between the magnetic metal clip 7 and the yoke plate 4. There is a positioning frame 22 extending upward from the positioning plate 6, and the magnetic metal clip 7 is sleeved on the outer periphery of the positioning frame so as to promise no deflection of the magnetic metal clip in the horizontal direction.

Figure 2:
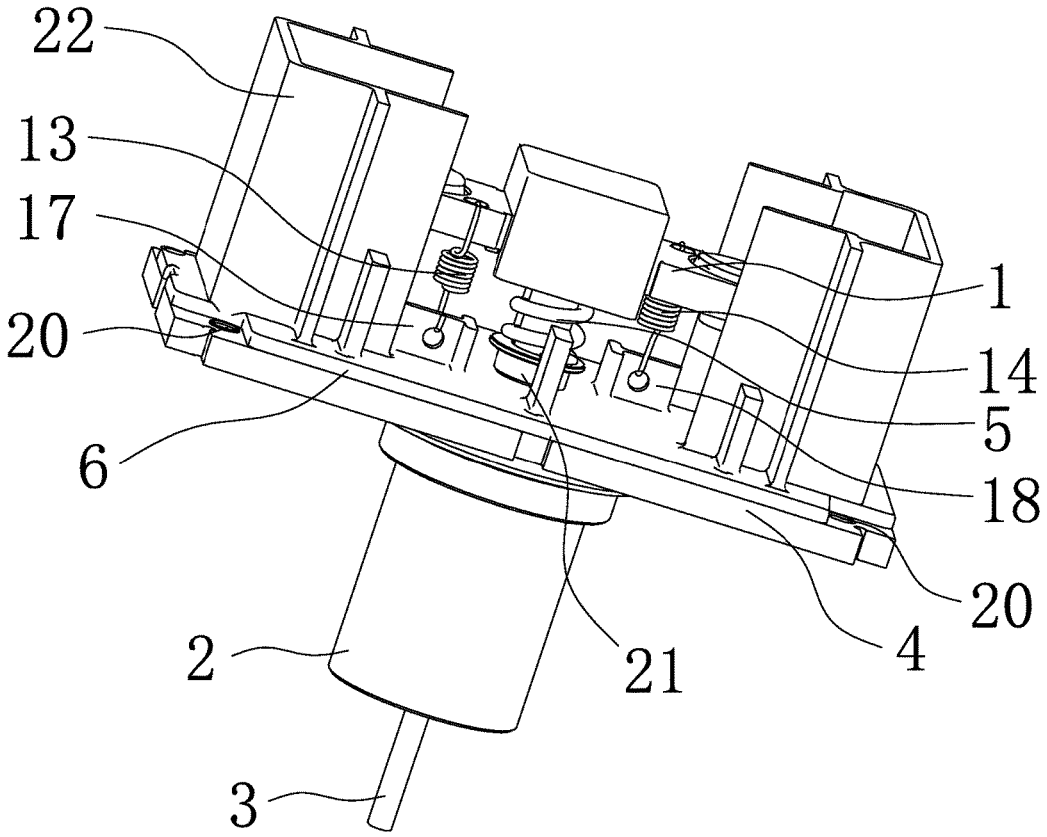
FIG. 2 is a second structure diagram according to Embodiment 1 of the present invention.
Figure 3:
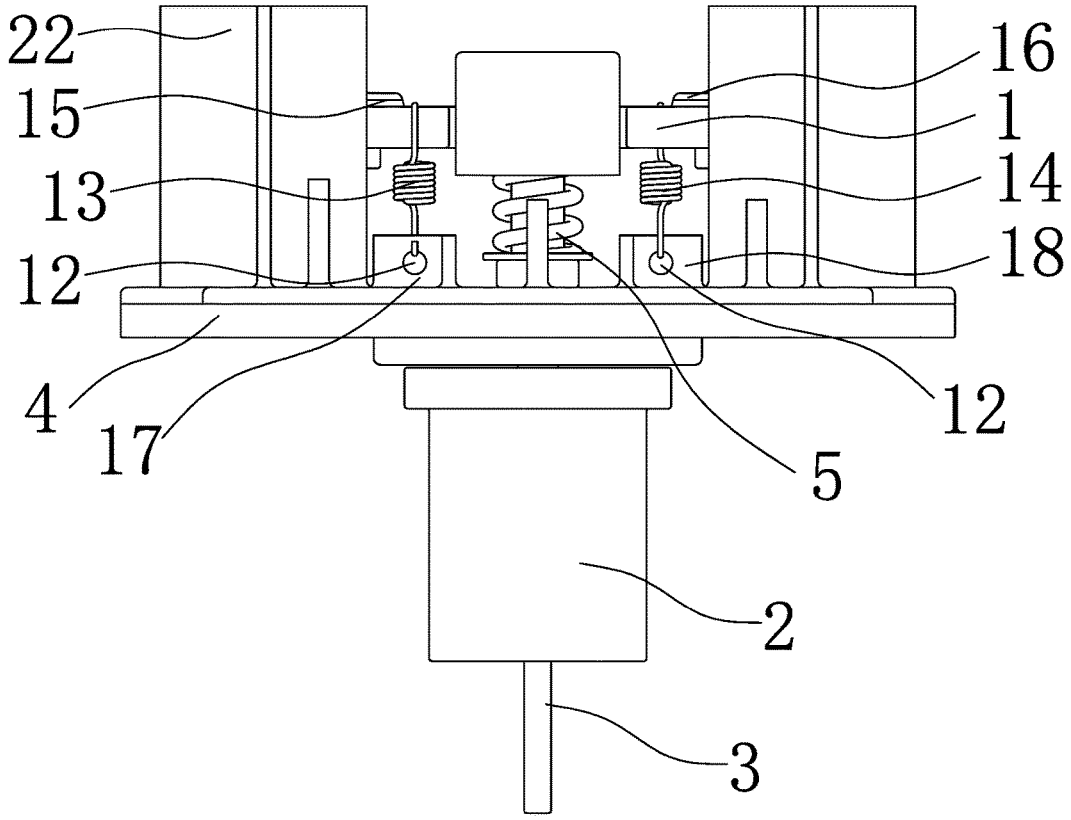
FIG. 3 is a third structure diagram according to Embodiment 1 of the present invention.
Figure 4:
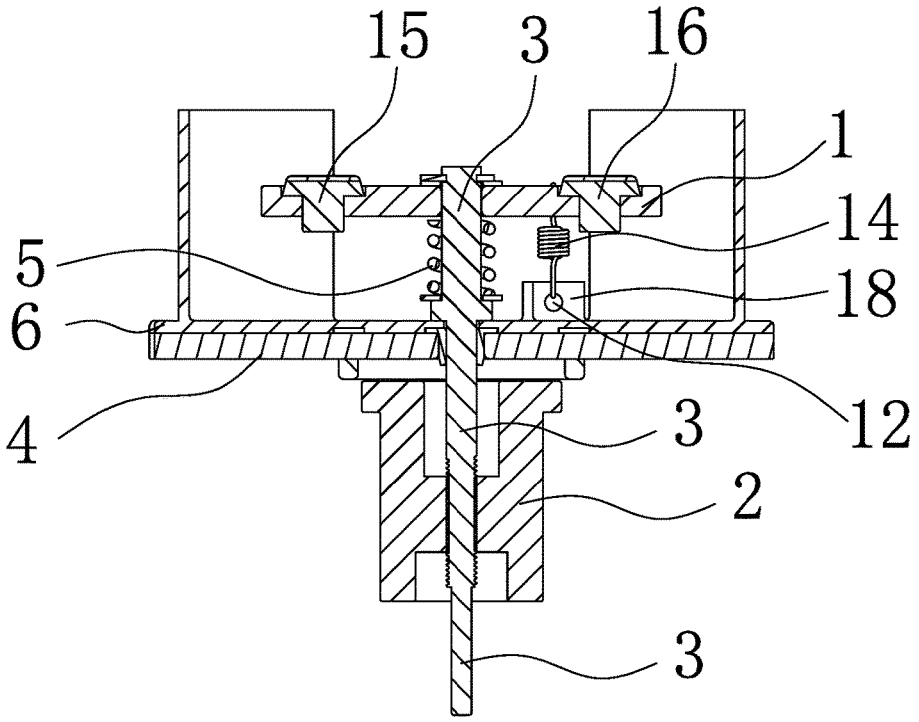
FIG. 4 is a sectional view of FIG. 3.
Figure 5:
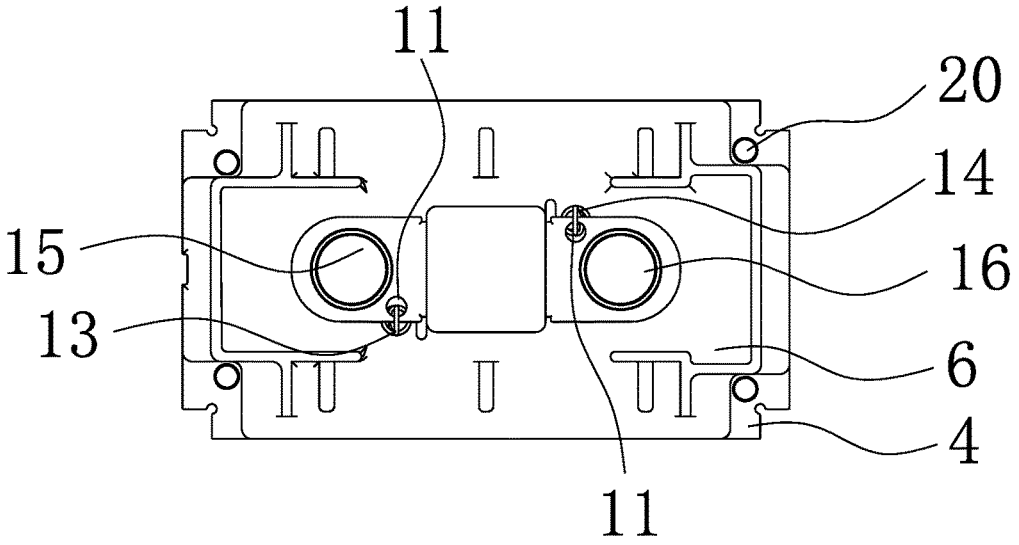
FIG. 5 is a top plan view of FIG. 3.
Figure 6:
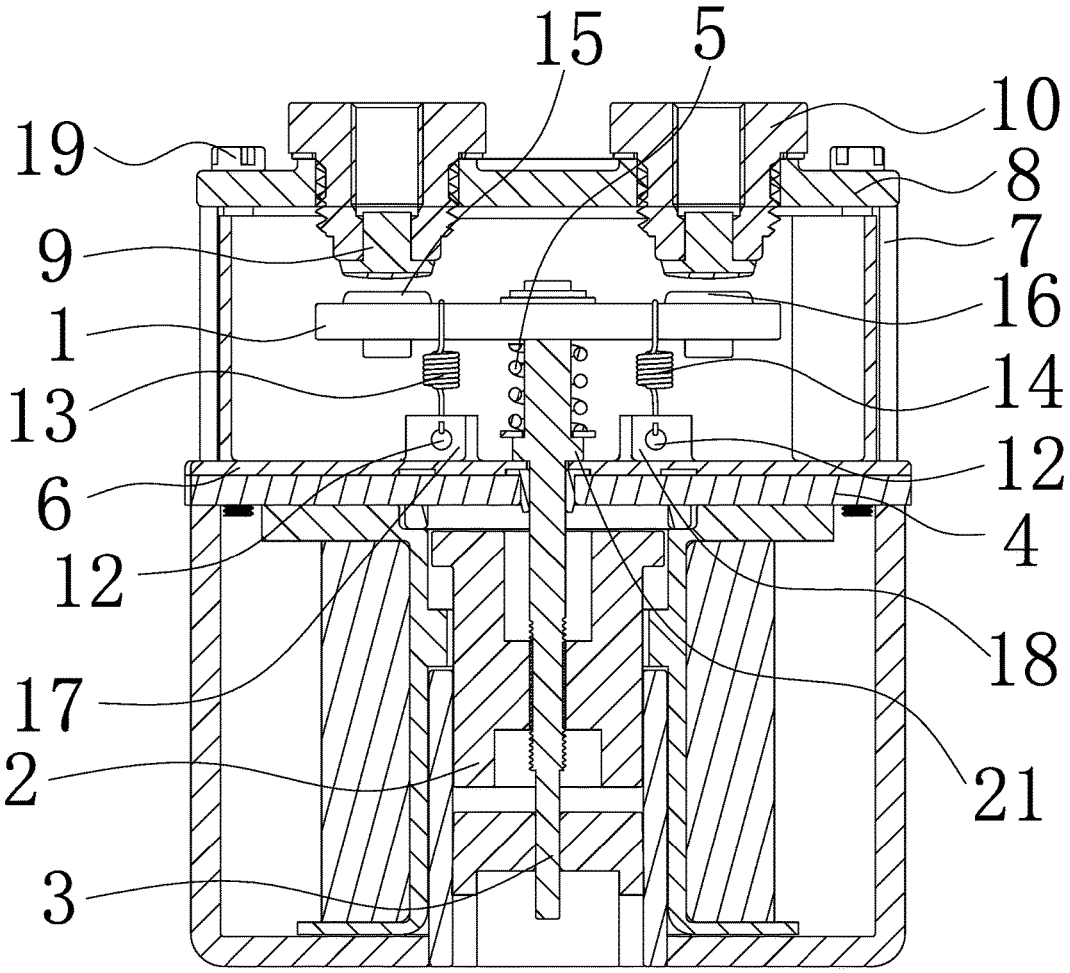
FIG. 6 is a first structure diagram according to Embodiment 2 of the present invention.
Figure 7:
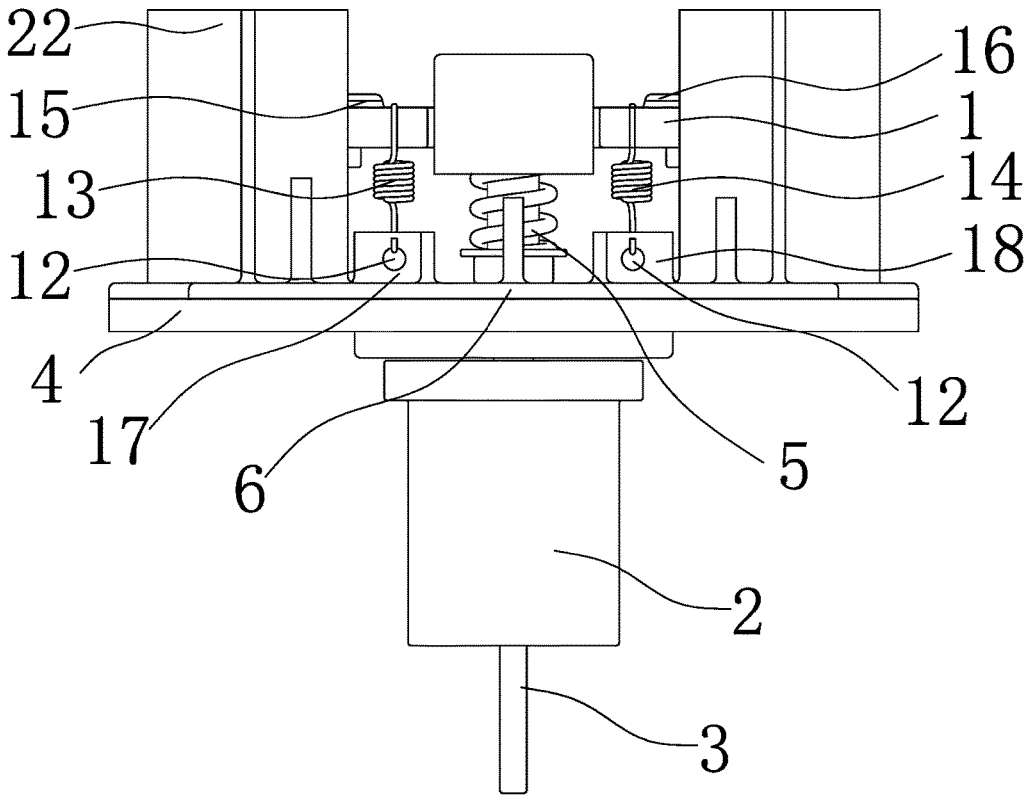
FIG. 7 is a second structure diagram according to Embodiment 2 of the present invention.
Figure 8:
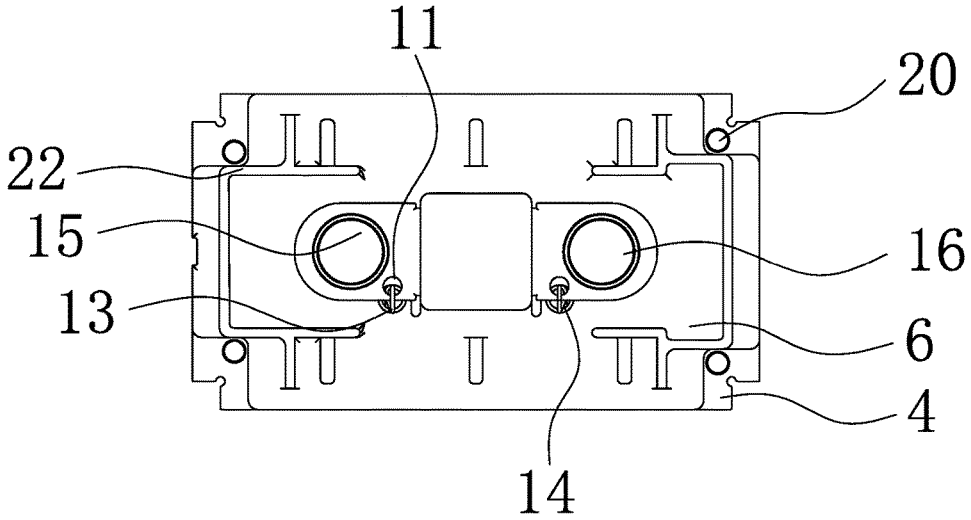
FIG. 8 is a third structure diagram according to Embodiment 2 of the present invention.
Figure 9:
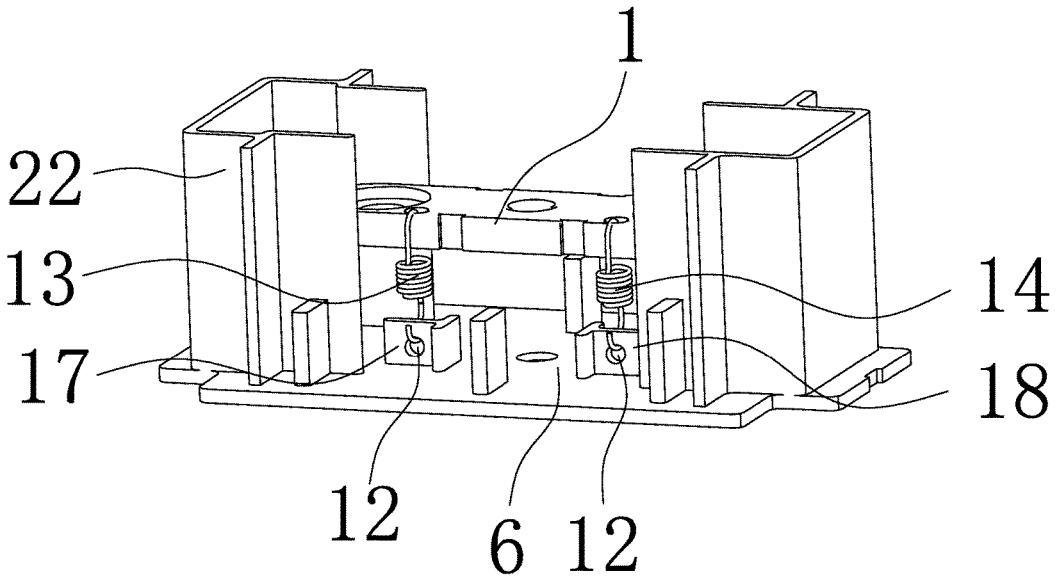
FIG. 9 is a fourth structure according to Embodiment 2 of the present invention.

As shown in FIG. 1 and FIG. 2, both the insulating plate 8 and the yoke plate 4 are square structures. A first fixing hole is formed at each of the four corners of the insulating plate 8; a second fixing hole 20 is formed at each of the four corners of the yoke plate 4; and retreating gaps for the second fixing holes 20 are formed at the four corners of the positioning plate 6. The fastener is a bolt 19. One bolt 19 is fitted inside each first fixing hole. The first fixing holes and the second fixing holes correspond one by one in terms of position. The bolt 19, after passing through the first fixing hole, is fixed by threads with the second fixing hole so that a lower end of the bolt 19 is fixed with the yoke plate and the head portion of the bolt 19 compacts the insulating plate 8.

Embodiment 2

As shown in FIG. 6, FIG. 7, FIG. 8 and FIG. 9, the present invention provides a horizontal-deflection prevention mechanism for an HVDC relay, including a moving contact assembly which comprises a moving reed 1 and moving contacts arranged at left and right ends of the moving reed 1; an upper section of a pushrod 3 fixed with a moving iron core 2 is located above a yoke plate 4 and fixed with the moving reed 1; a main spring 5 is sleeved on the pushrod 3; a positioning plate 6 made of insulating plastic is provided on the yoke plate 4; a left return spring 13 is connected between a left end of the moving reed 1 and the positioning plate 6, and a right return spring 14 is connected between a right end of the moving reed 1 and the positioning plate 6; and both the left return spring 13 and the right return spring 14 are S-shaped extension springs. A boss 21 is formed on an upper section of the pushrod 3 located above the yoke plate 4; and a lower end of the main spring 5 resists against the boss 21, and an upper end of the main spring 5 resists against the moving reed 1.

Both an axis of the left return spring 13 and an axis of the right return spring 14 are parallel to an axis of the pushrod 3; and both a connecting point between the left return spring 13 and the moving reed 1 and a connecting point between the right return spring 14 and the moving reed 1 are located between the two moving contacts and are close to an inner side of the moving contacts.

An upper spring fixing hole 11 is provided at a left end of the moving reed, and an upper spring fixing hole 11 is provided at a right end of the moving reed; and an upper end of the left return spring 13 is located inside the upper spring fixing hole at the left end, and an upper end of the right return spring 14 is located inside the upper spring fixing hole at the right end. The moving contacts comprise a left moving contact 15 and a right moving contact 16; and the upper spring fixing hole 11 at the left end of the moving reed is located on the inner side of the left moving contact 15, and the upper spring fixing hole 11 at the right end of the moving reed is located on the inner side of the right moving contact 16.

A spring fixing plate extending upward is respectively formed on the positioning plate 6 at a position below and corresponding to the left end of the moving reed 1 and at a position below and corresponding to the right end of the moving reed; a lower spring fixing hole 12 is formed on the spring fixing plate; and a protection ring is matched on an inner wall of the lower spring fixing hole 12, and the protection ring is an iron ring. The spring fixing plate comprises a left spring fixing plate 17 located on the left side and a right fixing plate 18 located on the right side; and a lower spring fixing hole 12 is formed on each of the left spring fixing plate 17 and the right spring fixing plate 18.

Both the connecting point between the left return spring 13 and the moving reed 1 and the connecting point between the right return spring 14 and the moving reed 1 are located on the front side of the moving reed 1. The upper spring fixing hole of the left return spring 13 is located on the front side of the moving reed, and the upper spring fixing hole of the right return spring 14 is also located on the front side of the moving reed.

A magnetic metal clip 7 having an enclosed structure and an insulating plate 8 made of ceramic are provided on an upper side of the yoke plate 4; the yoke plate 4 and the insulating plate 8 are fixed by a fastener so that the magnetic metal clip 7 is defined between the yoke plate 4 and the insulating plate 8; a chamber for accommodating a stationary contact assembly and a moving contact assembly is formed by the insulating plate 8, the magnetic metal clip 7 and the yoke plate 4; the stationary contact assembly comprises a leading-out end 10 and stationary contacts 9 fixed on the leading-out end, and the leading-out end 10 and the insulating plate 8 are brazed or fixed by threads; an upper end surface of the positioning plate resists against the lower end of the magnetic metal clip, and a lower end surface of the positioning plate resists against the yoke plate; and the positioning plate 6 is tightly clamped between the magnetic metal clip 7 and the yoke plate 4. There is a positioning frame 22 extending upward from the positioning plate 6, and the magnetic metal clip 7 is sleeved on the outer periphery of the positioning frame so as to promise no deflection of the magnetic metal clip in the horizontal direction.

Both the insulating plate 8 and the yoke plate 4 are square structures. A first fixing hole is formed at each of the four corners of the insulating plate 8; a second fixing hole 20 is formed at each of the four corners of the yoke plate 4; and retreating gaps for the second fixing holes 20 are formed at four corners of the positioning plate 6. The fastener is a bolt 19. One bolt 19 is matched inside each first fixing hole. The first fixing holes and the second fixing holes correspond one by one in terms of position. The bolt 19, after passing through the first fixing hole, is fixed by threads with the second fixing hole so that a lower end of the bolt 19 is fixed with the yoke plate and the head portion of the bolt 19 compacts the insulating plate 8.

Embodiment 3

Figure 10:
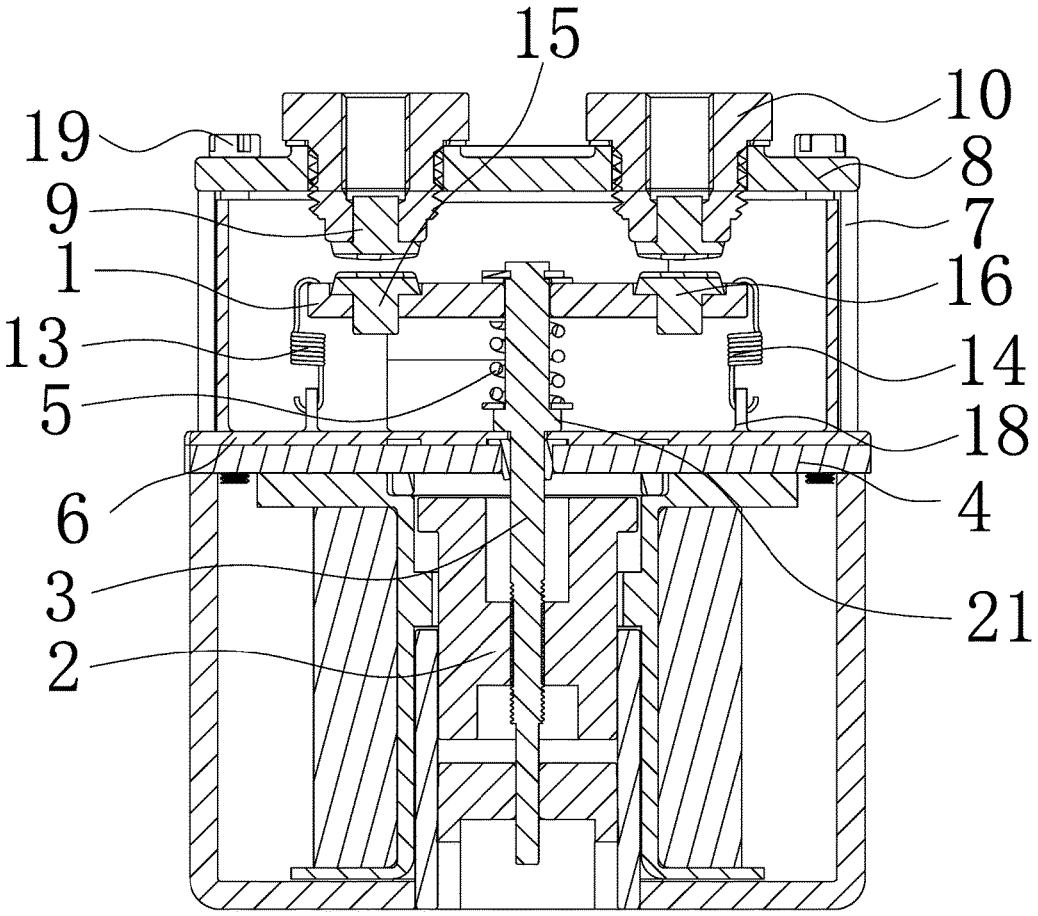
FIG. 10 is a first structure diagram according to Embodiment 3 of the present invention.
Figure 11:
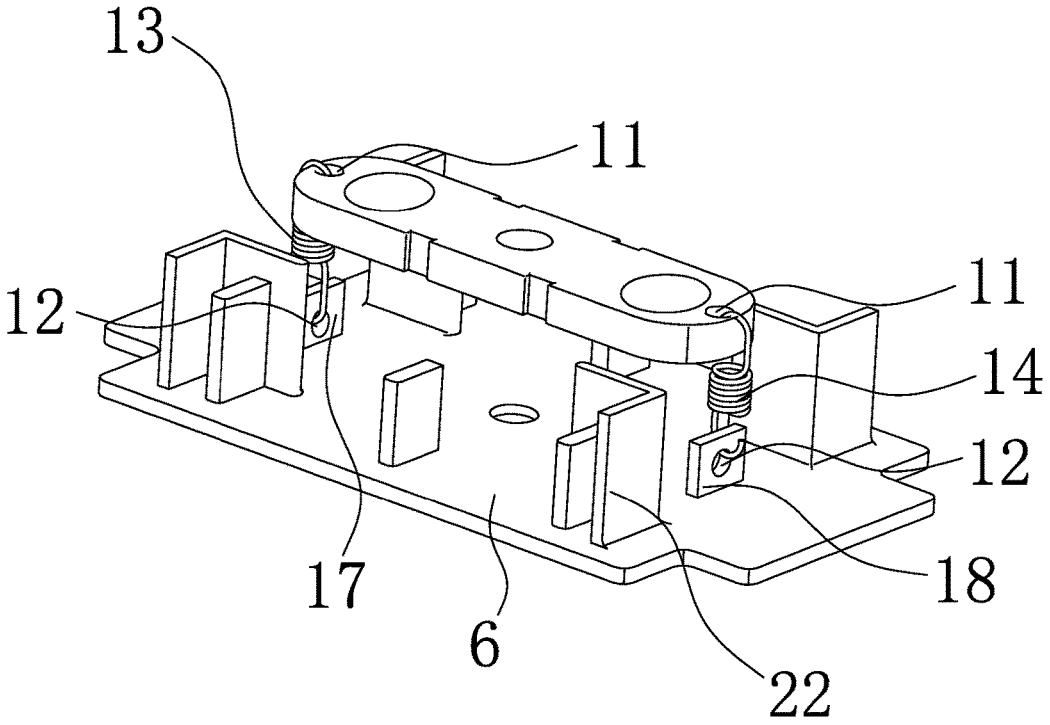
FIG. 11 is a second structure diagram according to Embodiment 3 of the present invention.
Figure 12:
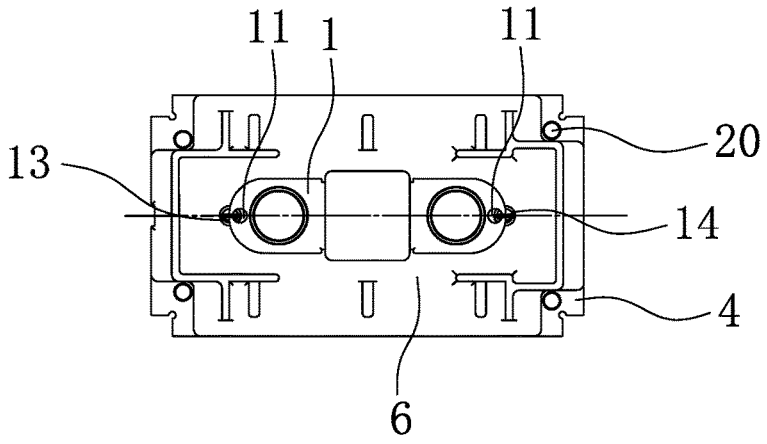
FIG. 12 is a third structure diagram according to Embodiment 3 of the present invention.

As shown in FIG. 10, FIG. 11 and FIG. 12, the present invention provides a horizontal-deflection prevention mechanism for an HVDC relay, including a moving contact assembly which comprises a moving reed 1 and moving contacts arranged at left and right ends of the moving reed 1; an upper section of a pushrod 3 fixed with a moving iron core 2 is located above a yoke plate 4 and fixed with the moving reed 1; a main spring 5 is sleeved on the pushrod 3; a positioning plate 6 made of insulating plastic is provided on the yoke plate 4; a left return spring 13 is connected between a left end of the moving reed 1 and the positioning plate 6, and a right return spring 14 is connected between a right end of the moving reed 1 and the positioning plate 6; and both the left return spring 13 and the right return spring 14 are S-shaped extension springs. A boss 21 is formed on an upper section of the pushrod 3 located above the yoke plate 5; and a lower end of the main spring 5 resists against the boss 21, and an upper end of the main spring 5 resists against the moving reed 1.Both an axis of the left return spring 13 and an axis of the right return spring 14 are parallel to an axis of the pushrod 3.

An upper spring fixing hole 11 is provided at a left end of the moving reed, an upper spring fixing hole 11 is provided at a right end of the moving reed; and an upper end of the left return spring 13 is located inside the upper spring fixing hole at the left end, and an upper end of the right return spring 14 is located inside the upper spring fixing hole at the right end. The moving contacts comprise a left moving contact 15 and a right moving contact 16; and the upper spring fixing hole 11 at the left end of the moving reed is located on an outer side of the left moving contact 15, and the upper spring fixing hole 11 at the right end of the moving reed is located on an outer side of the right moving contact 16.

A spring fixing plate extending upward is respectively formed on the positioning plate 6 at a position below and corresponding to the left end of the moving reed 1 and at a position below and corresponding to the right end of the moving reed; a lower spring fixing hole 12 is formed on the spring fixing plate; and a protection ring is matched on an inner wall of the lower spring fixing hole 12, and the protection ring is an iron ring. The spring fixing plate comprises a left spring fixing plate 17 located on the left side and a right fixing plate 18 located on the right side; and a lower spring fixing hole 12 is formed on each of the left spring fixing plate 17 and the right spring fixing plate 18.

Both the connecting point between the left return spring 13 and the moving reed 1 and the connecting point between the right return spring 14 and the moving reed 1 are located in a front-rear symmetric centerline of the moving reed 1. That is, the upper spring fixing hole of the left return spring 13 and the upper spring fixing hole of the right return spring 14 are located in a front-rear symmetric centerline of the moving reed. The left spring fixing plate 17 and the right spring fixing plate 18 are symmetrically arranged on the positioning plate 6. An axis of the lower spring fixing hole 11 of the left spring fixing plate 17 and an axis of the lower spring fixing hole 11 of the right spring fixing plate 18 are located in a same straight line.

As shown in FIG. 10, a magnetic metal clip 7 having an enclosed structure and an insulating plate 8 made of ceramic are provided on an upper side of the yoke plate 4; the yoke plate 4 and the insulating plate 8 are fixed by a fastener so that the magnetic metal clip 7 is defined between the yoke plate 4 and the insulating plate 8; a chamber for accommodating a stationary contact assembly and a moving contact assembly is formed by the insulating plate 8, the magnetic metal clip 7 and the yoke plate 4; the stationary contact assembly comprises a leading-out end 10 and stationary contacts 9 fixed on the leading-out end, and the leading-out end 10 and the insulating plate 8 are brazed or fixed by threads; an upper end surface of the positioning plate resists against the lower end of the magnetic metal clip, and a lower end surface of the positioning plate resists against the yoke plate; and the positioning plate 6 is tightly clamped between the magnetic metal clip 7 and the yoke plate 4. There is a positioning frame 22 extending upward from the positioning plate 6, and the magnetic metal clip 7 is sleeved on the outer periphery of the positioning frame so as to promise no deflection of the magnetic metal clip in the horizontal direction.

As shown in FIG. 10 and FIG. 12, both the insulating plate 8 and the yoke plate 4 are square structures. A first fixing hole is formed at each of the four corners of the insulating plate 8; a second fixing hole 20 is formed at each of the four corners of the yoke plate 4; and retreating gaps for the second fixing holes 20 are formed at four corners of the positioning plate 6. The fastener is a bolt 19. One bolt 19 is matched inside each first fixing hole. The first fixing holes and the second fixing holes correspond one by one in terms of position. The bolt 19, after passing through the first fixing hole, is fixed by threads with the second fixing hole so that a lower end of the bolt 19 is fixed with the yoke plate and the head portion of the bolt 19 compresses the insulating plate 8.

The horizontal-deflection prevention mechanism of the present invention is used in HVDC relays and has the advantages of preventing a moving reed from deflecting horizontally, ensuring the precise contact between the moving contacts and the stationary contacts of the relay, improving the reliability of the relay, and the like.

The invention claimed is:

1. A horizontal-deflection prevention mechanism for a high voltage direct current (HVDC) relay, comprising a moving contact assembly which comprises a moving reed and moving contacts arranged at left and right ends of the moving reed; an upper section of a pushrod is located above a yoke plate and fixed with the moving reed; a positioning plate is provided on the yoke plate; and a left return spring is connected between a left end of the moving reed and the positioning plate, and a right return spring is connected between a right end of the moving reed and the positioning plate.

2. The horizontal-deflection prevention mechanism for an HVDC relay according to claim 1, characterized in that a spring fixing plate extending upward is respectively formed on the positioning plate at a position below and corresponding to the left end of the moving reed and at a position below and corresponding to the right end of the moving reed; a lower spring fixing hole is formed on the spring fixing plate; and a protection ring is matched on an inner wall of the lower spring fixing hole.

3. The horizontal-deflection prevention mechanism for an HVDC relay according to claim 1, characterized in that both an axis of the left return spring and an axis of the right return spring are parallel to an axis of the pushrod; and both a connecting point between the left return spring and the moving reed and a connecting point between the right return spring and the moving reed are located between the two moving contacts and are close to an inner side of the moving contacts.

4. The horizontal-deflection prevention mechanism for an HVDC relay according to claim 1, characterized in that the connecting point between the left return spring and the moving reed and the connecting point between the right return spring and the moving reed are separately located on a front side and a rear side of the moving reed.

5. The horizontal-deflection prevention mechanism for an HVDC relay according to claim 1, characterized in that both the connecting point between the left return spring and the moving reed and the connecting point between the right return spring and the moving reed are located on a front side of the moving reed or on a rear side of the moving reed.

6. The horizontal-deflection prevention mechanism for an HVDC relay according to claim 1, characterized in that the connecting point between the left return spring and the moving reed and the connecting point between the right return spring and the moving reed are located in a front-rear symmetric centerline of the moving reed.

7. The horizontal-deflection prevention mechanism for an HVDC relay according to claim 1, characterized in that an upper spring fixing hole is respectively provided on two ends of the moving reed; the spring fixing plate comprises a left spring fixing plate and a right spring fixing plate; and a lower spring fixing hole is formed on the left spring fixing plate, and a lower spring fixing hole is formed on the right spring fixing plate.

8. The horizontal-deflection prevention mechanism for an HVDC relay according to claim 1, characterized in that both the left return spring and the right return spring are S-shaped extension springs.

9. The horizontal-deflection prevention mechanism for an HVDC relay according to claim 1, characterized in that a magnetic metal clip having an enclosed structure and an insulating plate are provided on the yoke plate; the yoke plate and the insulating plate are fixed by a fastener so that the magnetic metal clip is defined between the yoke plate and the insulating plate; a chamber for accommodating a stationary contact assembly and a moving contact assembly is formed by the insulating plate, the magnetic metal clip and the yoke plate; the stationary contact assembly comprises a leading-out end and stationary contacts fixed on the leading-out end, and the leading-out end is fixed with the insulating plate; and an upper end surface of the positioning plate resists against the magnetic metal clip, and a lower end surface of the positioning plate resists against the yoke plate.

10. The horizontal-deflection prevention mechanism for an HVDC relay according to claim 9, characterized in that there is a positioning frame extending upward from the positioning plate, and the magnetic metal clip is sleeved on an outer periphery of the positioning frame.

11. The horizontal-deflection prevention mechanism for an HVDC relay according to claim 2, characterized in that both an axis of the left return spring and an axis of the right return spring are parallel to an axis of the pushrod; and both a connecting point between the left return spring and the moving reed and a connecting point between the right return spring and the moving reed are located between the two moving contacts and are close to an inner side of the moving contacts.

12. The horizontal-deflection prevention mechanism for an HVDC relay according to claim 2, characterized in that the connecting point between the left return spring and the moving reed and the connecting point between the right return spring and the moving reed are separately located on a front side and a rear side of the moving reed.

13. The horizontal-deflection prevention mechanism for an HVDC relay according to claim 2, characterized in that both the connecting point between the left return spring and the moving reed and the connecting point between the right return spring and the moving reed are located on a front side of the moving reed or on a rear side of the moving reed.

14. The horizontal-deflection prevention mechanism for an HVDC relay according to claim 2, characterized in that the connecting point between the left return spring and the moving reed and the connecting point between the right return spring and the moving reed are located in a front-rear symmetric centerline of the moving reed.

15. The horizontal-deflection prevention mechanism for an HVDC relay according to claim 2, characterized in that an upper spring fixing hole is respectively provided on two ends of the moving reed; the spring fixing plate comprises a left spring fixing plate and a right spring fixing plate; and a lower spring fixing hole is formed on the left spring fixing plate, and a lower spring fixing hole is formed on the right spring fixing plate.

16. The horizontal-deflection prevention mechanism for an HVDC relay according to claim 2, characterized in that both the left return spring and the right return spring are S-shaped extension springs.

* * * * *